US005092072A

United States Patent [19]

Fritts

[11] Patent Number: 5,092,072

[45] Date of Patent: Mar. 3, 1992

[54] MUZZLE LOADING DEVICE

[76] Inventor: Gary N. Fritts, P.O. Box 367, Dayton, Tenn. 37321

[21] Appl. No.: 599,736

[22] Filed: Oct. 19, 1990

[51] Int. Cl.[5] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 4,112,606 | 9/1978 | Griffin | 42/90 |
| 4,135,322 | 1/1979 | Tice et al. | 42/90 |
| 4,222,305 | 10/1980 | Lee | 86/37 |
| 4,411,088 | 10/1983 | Wilson | 42/90 |
| 4,442,620 | 4/1984 | Drake et al. | 42/90 |
| 4,550,517 | 11/1985 | Mansfield | 42/90 |
| 4,589,220 | 5/1986 | Lofland | 42/90 |
| 4,607,446 | 8/1986 | Scheuring | 42/90 |
| 4,802,297 | 2/1989 | French | 42/90 |

*Primary Examiner*—Charles T. Jordan
*Attorney, Agent, or Firm*—Pitts and Brittian

[57] ABSTRACT

A muzzle loading device (10) for storing and dispensing projectiles (30), propellants (34) and priming caps (36) used in muzzle loading firearms (22) and for receiving ramrods (28) while packing a shot or while cleaning the barrel (64) of a muzzle loading firearm (22). A plurality of through holes (46) are dimensioned to closely receive projectiles (30). A propellant reservoir (16) is dimensioned to hold a measured amount of propellant and to be received by the muzzle (24) of a barrel (64) while dispensing propellant (34) and while inserting a ramrod (28) into the barrel (64) in order to protect the muzzle (24) from the ramrod (28). A plurality of recesses (18) are located on an extended portion (76) of the housing (12) and are dimensioned to closely receive priming caps (36), the extended portion (76) being dimensioned to be inserted into the breech (26) of the firearm (22) to deposit a priming cap (36) onto the nipple (78) of the firearm (22). A recess (21) is dimensioned to receive one end (68) of the ramrod (28) after the ramrod (28) is inserted into the barrel (64) so that the muzzle loading device (10) is used as a handle for the ramrod (28).

10 Claims, 3 Drawing Sheets

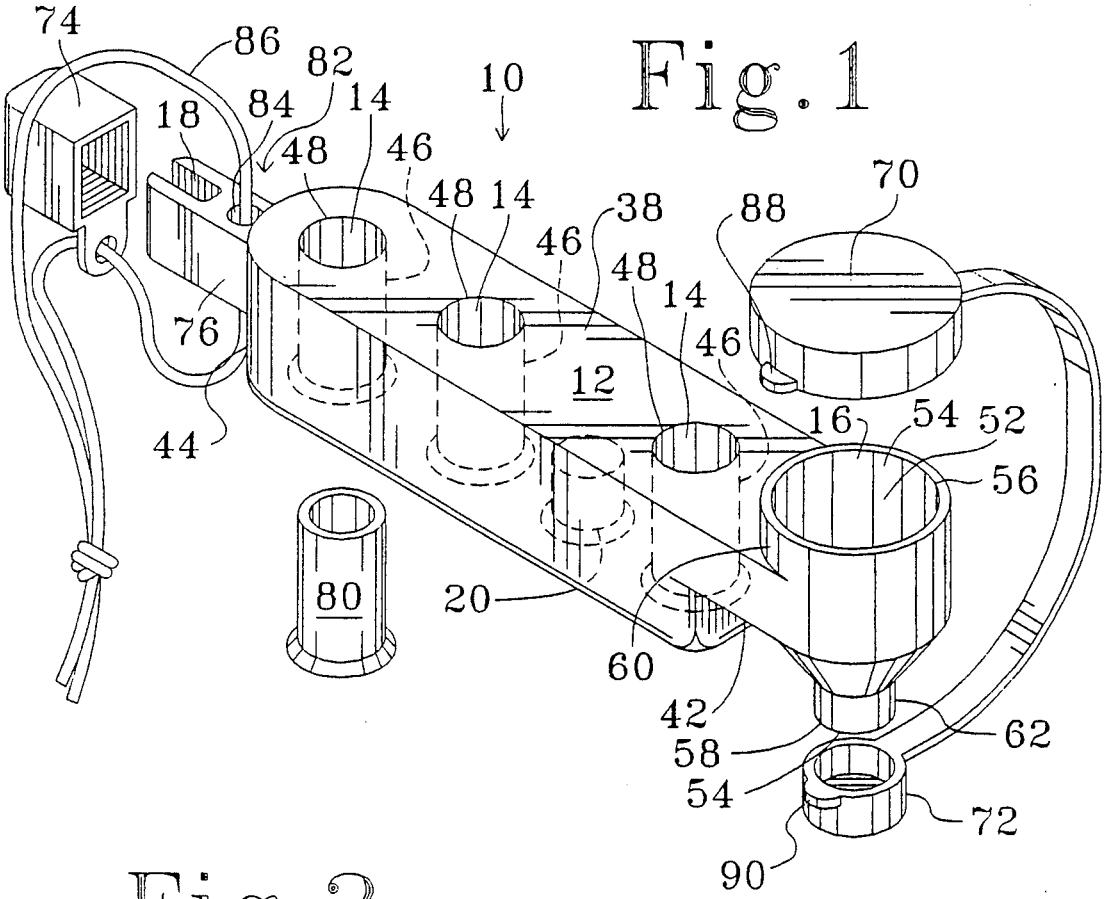
Fig. 1
Fig. 2
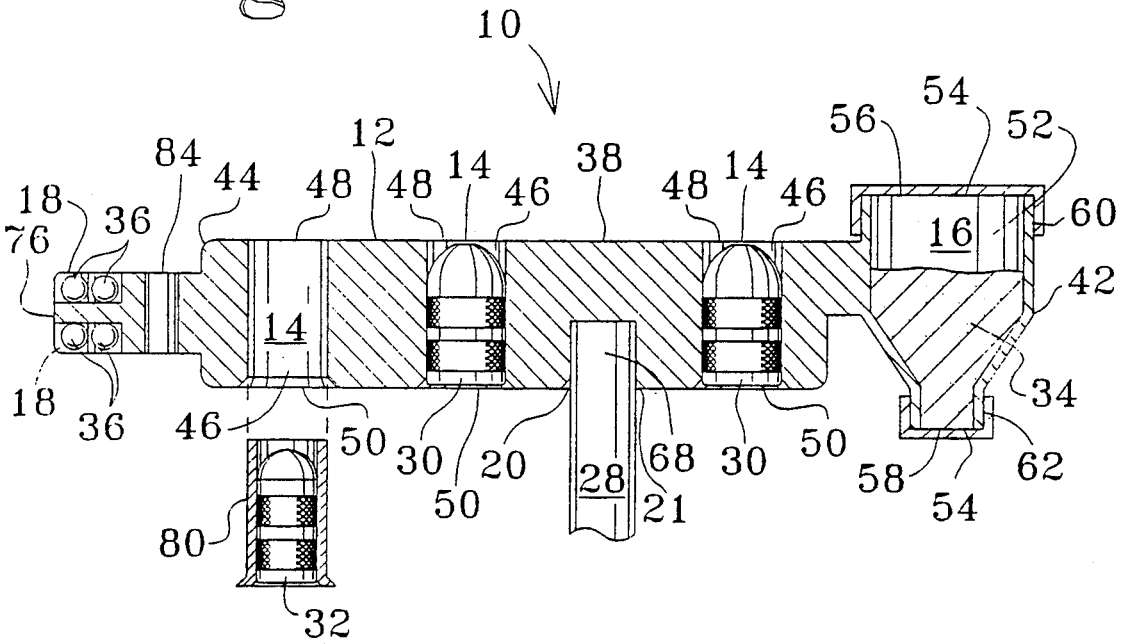

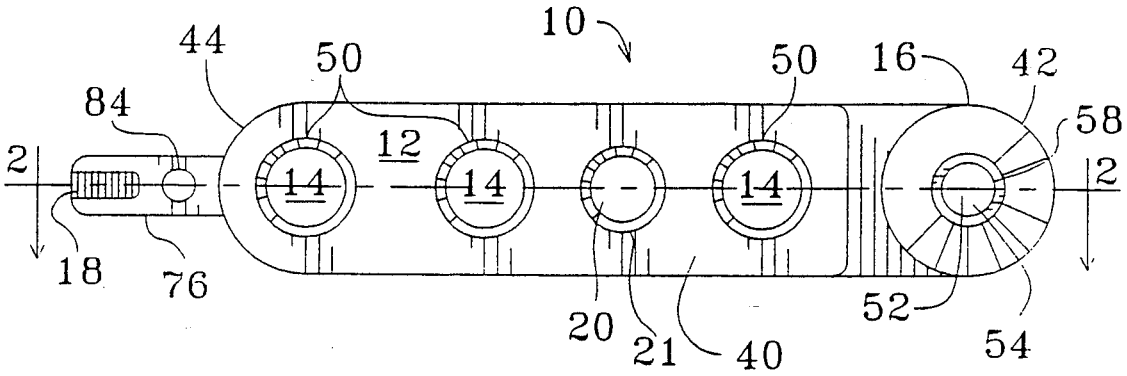
Fig. 3
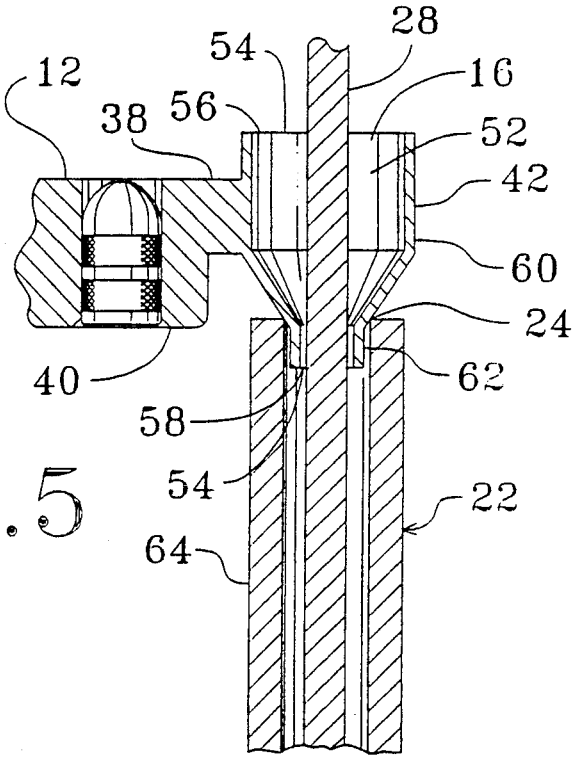
Fig. 5
Fig. 4
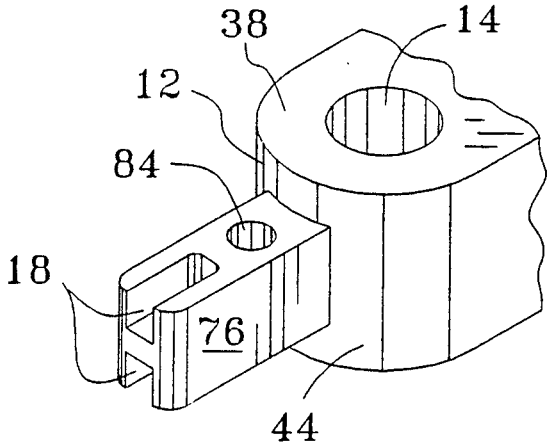

MUZZLE LOADING DEVICE

TECHNICAL FIELD

This invention relates to the field of muzzle loading firearms. More specifically, it relates to a device for storing and dispensing projectiles and projectile components related to muzzle loading rifles, pistols and shotguns.

BACKGROUND ART

In the field of muzzle loading firearms, it is known that the elements of a shot are each loaded in the firearm separately, as opposed to a cartridge or shell of a conventional firearm in which all of the necessary elements are stored. A muzzle loader requires the loading of the propellant and a projectile through the discharge end, or muzzle, of the barrel, and the loading of the primer through the firing end. This method of loading requires a greater amount of time than for conventional firearms, and creates an additional problem of spilling propellant. Muzzle loaders also require the use of a ramrod, both for loading and cleaning, which is inserted in the muzzle of the barrel and pushed toward the bolt, causing the ramrod and muzzle to strike against one another, thereby damaging the barrel and reducing the effectiveness of the shot.

Several devices have been designed to aid the shooter in loading a firearm. Typical of the art are the devices disclosed in U.S. Pat. Nos. 4,222,305 issued to Richard J. Lee on Sept. 6, 1980; 4,411,088 issued to Hugh R. Wilson on Oct. 25, 1983; and 4,802,297 issued to Kendrick L. French on Feb. 7, 1989. Of these patents, only the 4,411,088 patent specifically attempts to solve the problems related to loading a muzzle loader. That patent describes a device for storing the elements of a shot, but does not provide an adequate means to measure the propellant nor to prevent spillage while discharging the propellant from the device into the muzzle. Nor does the patent provide a means for protecting the barrel from the damage caused by the insertion of a ramrod.

Accordingly, it is an object of this invention to provide a means whereby the components required for firing a muzzle loading firearm are stored within the same embodiment for quick accessibility.

Another object of this invention is to provide a means whereby the propellant may be accurately measured and dispensed such that no spillage of the propellant occurs while loading the firearm.

Still another purpose of this invention is to provide a means whereby the barrel of the firearm is protected from the harmful effects of an inserted ramrod.

Yet another object of the present invention is to provide a means whereby the components are shielded from moisture and contamination.

DISCLOSURE OF THE INVENTION

Other objects and advantages will be accomplished by the present invention which serves to secure projectiles and projectile components necessary for loading a muzzle loading firearm, to measure and dispense propellant without spillage, to shield the projectile components from moisture and contamination, and to protect the muzzle from damages caused by inserting a ramrod. The muzzle loading device of the present invention includes a housing which is fabricated from a lightweight, durable material such as plastic. A projectile engaging means is carried by the housing and includes at least one receptacle for securing projectiles. In the preferred embodiment at least one projectile receptacle comprises a hole opening on opposing sides of the housing dimensioned to closely receive a projectile, at least one opening being chamfered to facilitate the entry of the projectile.

A propellant receiving means is also carried by the housing and includes at least one reservoir for measuring, containing and dispensing a selected volume of propellant, the reservoir being selectively opened and closed. In the preferred embodiment, the propellant receiving means is funnel-shaped with a larger opening to receive the propellant and a smaller opening to dispense the propellant. The smaller opening of the preferred embodiment is provided with an extension dimensioned such that the extension may be inserted into the muzzle of the firearm while dispensing the propellant and while inserting the ramrod, thus serving to prevent propellant spillage and to prevent damage to the barrel by the insertion of the ramrod. In the preferred embodiment, each opening is provided with a cover to facilitate opening and closing and to shield the propellant from moisture and contamination. The covers in the preferred embodiment are dimensioned to closely receive the respective openings and to be frictionally held in place.

A priming cap engaging means is also carried by the housing and includes at least one receptacle to secure and dispense priming caps, the priming cap engaging means being selectively opened and closed. In the preferred embodiment, the priming cap engaging means is extended from one end of the elongated body and is dimensioned such that the extended portion may be inserted into the breech of the firearm, the priming cap deposited on the nipple of the firearm, and the extended portion removed, leaving the priming cap in the firing position. In the preferred embodiment, the priming caps are shielded by a priming cap cover which is dimensioned to closely receive the priming cap engaging means and to be frictionally held in place.

A ramrod engaging means is also carried by the housing and a recess opening on one face of the housing. The recess is dimensioned to receive one end of a ramrod. In the preferred embodiment, the recess opens on the bottom face of the housing and is chamfered to facilitate engagement of the ramrod end.

BRIEF DESCRIPTION OF THE DRAWINGS

The above mentioned features of the invention will become more clearly understood from the following detailed description of the invention read together with the drawings in which:

FIG. 1 is a perspective view of the muzzle loading device constructed in accordance with several features of the present invention showing the covers and insert removed from the device.

FIG. 2 illustrates a side elevation view, in section, of the muzzle loading device taken at 2—2 of FIG. 3.

FIG. 3 is a bottom view of the device shown in FIG. 1 showing the ramrod engaging means and the chamfered openings of the ramrod engaging means and projectile engaging means.

FIG. 4 is a perspective view of a portion of the device in FIG. 1 showing the priming cap engaging means.

FIG. 5 is a partial side elevation view, in section, of the muzzle loading device taken at 2—2 of FIG. 3 showing the propellant receiving means being received by the muzzle of the firearm and receiving the ramrod.

Figure 6:
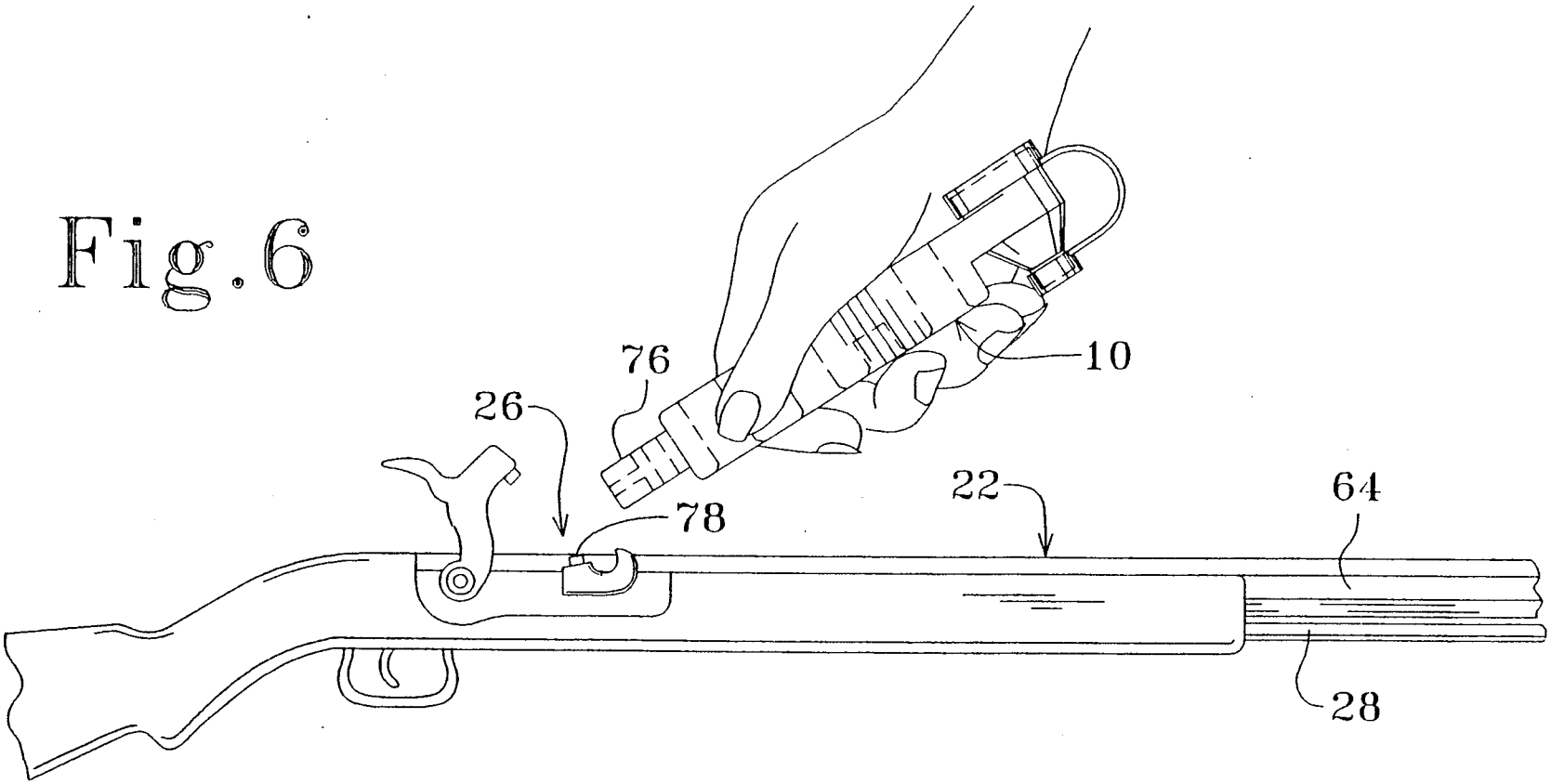

FIG. 6 is a partial side elevation view of a muzzle loading rifle showing the extended portion of the muzzle loading device being withdrawn from the breech of the rifle.

BEST MODE FOR CARRYING OUT THE INVENTION

A muzzle loading device incorporating various features of the present invention is illustrated generally at 10 in the figures. As best illustrated in FIG. 2, the device 10 is designed for securing and dispensing projectiles 30 of a selected caliber, priming caps 36, and propellants 34 used in muzzle loading firearms 22. The device 10 is also designed to provide a means for measuring and dispensing propellants 34 without spillage. Moreover, in the preferred embodiment the device 10 is designed to shield the propellants 34 and priming caps 36 from moisture and contamination, and to protect the muzzle 24 from damages caused by the injection of a ramrod 28.

The muzzle loading device 10 includes a housing 12. In the preferred embodiment the housing 12 is an elongated substantially rectangular configuration dimensioned to be received by a shooter's hand. The housing 12 of the preferred embodiment is fabricated from a lightweight, durable material such as plastic.

The housing 12 includes a projectile engaging means 14 defined by a plurality of through holes 46 opening on the top face 38 and bottom face 40 of the housing 12 at a substantially perpendicular angle. These holes 46 are spaced apart longitudinally along the housing 12 and each is dimensioned such that a projectile 30 with a first selected caliber may be closely received therein, as shown in FIG. 2, so that the projectile 30 does not substantially move with respect to the housing 12. In the preferred embodiment, the bottom face opening 50 of each projectile engaging means 14 is chamfered to facilitate the insertion of a projectile 30.

The housing 12 includes a propellant receptacle 16 defined by a plurality of reservoirs 52 for measuring, storing and dispensing a selected volume of propellant 34. The propellant receptacle 16 includes at least one opening 54 on the housing 12. In the preferred embodiment, the propellant receptacle 16 is connected to, or integral with, the housing 12 proximate the first end 42 and has a funnel-shaped configuration with a first diameter opening 56 on the top face 38 of the housing 12 and a smaller second diameter opening 58 on the bottom face 40 of the housing 12. The top opening 56 includes an extended portion 60 and the bottom opening 58 includes an extended portion 62, the top extended portion 60 and the bottom extended portion 62 extending in opposing directions at a substantially perpendicular angle to the housing 12. The bottom extended portion 62 is dimensioned such that the muzzle 24 of the firearm barrel 64 may receive the bottom extended portion 62 and the bottom extended portion 62 may receive the first end 66 of a ramrod 28, as shown in FIG. 5, so that the bottom extended portion 62 acts as a protective barrier between the firearm muzzle 24 and the ramrod 28 and prevents propellant 34 spillage while dispensing the propellant 34 into the muzzle 24. In the preferred embodiment the top opening 56 includes a cover 70 and the bottom opening 58 includes a cover 72 to facilitate opening and closing the propellant receptacle 16 and to shield the propellant 34 from moisture and contamination. The top cover 70 and the bottom cover 72 in the preferred embodiment are dimensioned to be closely received by the top extended portion 60 and the bottom extended portion 62 respectively and to be frictionally held in place. In the preferred embodiment, the top cover 70 includes a flange 88 and the bottom cover 72 includes a flange 90 to aid the user in selectively removing the respective covers 70 and 72.

The housing 12 includes a priming cap engaging means 18 defined by a plurality of recesses dimensioned to closely receive at least one priming cap 36. In the preferred embodiment, the priming cap engaging means 18 includes an extended section 76 with a substantially H-shaped configuration as shown in FIG. 4, the extended section 76 being extended from the second end 44 of the housing 12. As shown in FIG. 6, the priming cap engaging means 18 of the preferred embodiment is dimensioned such that the extended portion 76 may be inserted into the breech 26 of the firearm 22 for depositing a priming cap 36 onto the nipple 78 of the firearm 22. In the preferred embodiment, the priming caps 36 are shielded by a priming cap cover 74 which is dimensioned to closely receive the priming cap engaging means 18 and to be frictionally held in place.

The housing 12 includes a ramrod engaging means 20 defined by a recess opening on the housing 12 dimensioned to receive the second end 68 of a ramrod 28. In the preferred embodiment the ramrod engaging means 20 defines a recess which opens on the bottom face 40 of the housing 12 proximate the center, the opening 21 of the recess being chamfered to facilitate insertion of the ramrod end 68.

In the preferred embodiment, a caliber adaptor means 80 is included and has a substantially tubular configuration dimensioned to be closely received by the projectile engaging means 14 as shown in FIG. 2. The caliber adaptor means 80 of the preferred embodiment is further dimensioned to receive a projectile of a selected caliber 32 such that the projectile 32 does not substantially move with respect to the housing 12.

In the preferred embodiment, a carrying means 82 is carried by the housing 12 and includes a through hole 84 dimensioned to receive a cord 86 of a selected length. The hole 84 of the preferred embodiment is located proximate the second end 44 of the housing 12. The cord 86 of the preferred embodiment is fabricated from nylon or the like and is of a sufficient length to be hung around the shooter's neck.

From the foregoing description, it will be recognized by those skilled in the art that a muzzle loading device offering advantages over the prior art has been provided. Specifically, the muzzle loading device provides a means whereby the components required for firing a muzzle loading firearm are stored within the same embodiment for quick accessibility and shielded from moisture and contamination. The device also provides a means whereby the propellant may be accurately measured and dispensed such that no spillage of the propellant occurs while loading the firearm. The device also protects the barrel of the firearm from the harmful effects of an inserted ramrod.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A muzzle loading device for storing and dispensing projectiles and projectile components used in firing muzzle loading firearms comprising:

a housing;

a projectile engaging means carried by said housing for holding at least one projectile defining a selected caliber;

a propellant receptacle carried by said housing for holding a selected volume of propellant, said propellant receptacle defining a recess which may be selectively opened and closed;

a propellant cover means to shield said propellant from moisture and contamination, said propellant cover means being selectively removed and engaged;

a priming cap engaging means carried by said housing for holding at least one priming cap;

a priming cap cover means to shield said priming caps from moisture and contamination, said priming cap cover means being selectively removed and engaged;

a ramrod engaging means carried by said housing for receiving one end of a ramrod; and a caliber adaptor means to be received by said projectile engaging means for holding at least one projectile of a second selected caliber.

2. A muzzle loading device for storing and dispensing projectiles and projectile components used in firing muzzle loading firearms comprising:

a housing;

a projectile engaging means carried by said housing for holding at least one projectile defining a selected caliber;

a propellant receptacle carried by said housing for holding a selected volume of propellant, said propellant receptacle defining a recess which may be selectively opened and closed wherein said propellant receptacle is provided with a through hole opening on opposing sides and an extended section from at least one opening such that said extended section may be received by a firearm barrel and said opening may receive a ramrod;

a propellant cover means to shield said propellant from moisture and contamination, said propellant cover means being selectively removed and engaged;

a priming cap engaging means carried by said housing for holding at least one priming cap;

a priming cap cover means to shield said priming caps from moisture and contamination, said priming cap cover means being selectively removed and engaged;

a ramrod engaging means carried by said housing for receiving one end of a ramrod.

3. The muzzle loading device of claim 2 wherein said device further comprises a caliber adaptor means to be received by said projectile engaging means for holding at least one projectile of a second caliber.

4. The muzzle loading device of claim 2 wherein said priming cap engaging means is dimensioned to be received by the breech of said muzzle loading firearm.

5. A muzzle loading device for storing and dispensing projectiles and projectile components used in firing muzzle loading firearms comprising:

a housing;

a projectile engaging means carried by said housing for holding at least one projectile defining a selected caliber;

a propellant receptacle carried by said housing for holding a selected volume of propellant, said propellant receptacle defining a recess which may be selectively opened and closed;

a propellant cover means to shield said propellant from moisture and contamination, said propellant cover means being selectively removed and engaged;

a priming cap engaging means carried by said housing for holding at least one priming cap wherein said priming cap engaging means is dimensioned to be received by the breech of said muzzle loading firearm;

a priming cap cover means to shield said priming caps from moisture and contamination, said priming cap cover means being selectively removed and engaged;

a ramrod engaging means carried by said housing for receiving one end of a ramrod.

6. The muzzle loading device of claim 5 wherein said propellant receptacle is provided with a through hole opening on opposing sides and an extended section from at least one opening such that said extended section may be received by a firearm barrel and said opening may receive said ramrod.

7. A muzzle loading device for storing and dispensing projectiles and projectile components used in firing muzzle loading firearms comprising:

a housing;

a projectile engaging means carried by said housing for holding at least one projectile with a selected caliber;

a propellant receptacle carried by said housing for holding a selected volume of propellant, including a through hole opening on opposing sides and an extended section from at least one opening such that said extended section may be received by a firearm barrel and said opening may receive a ramrod, said propellant receptacle being selectively opened and closed;

a propellant cover means to shield said propellant from moisture and contamination, said propellant cover means being selectively removed and engaged;

a priming cap engaging means carried by said housing for holding at least one priming cap dimensioned to be received by breech of said muzzle loading firearm;

a priming cap cover means to shield said priming caps from moisture and contamination, said priming cap cover means being selectively removed and engaged;

a ramrod engaging means carried by said housing for receiving one end of a ramrod; and a caliber adaptor means to be received by said projectile engaging means for holding at least one projectile of a second selected caliber.

8. The muzzle loading device of claim 7 wherein said housing is fabricated from a durable material.

9. The housing of claim 8 wherein said durable material is plastic.

10. The muzzle loading device of claim 7 further comprising a carrying means connected to said housing used to facilitate transporting and storing said device.

* * * * *